US008552955B2

(12) United States Patent
Lin

(10) Patent No.: US 8,552,955 B2
(45) Date of Patent: Oct. 8, 2013

(54) RECEIVER FOR AN LCD SOURCE DRIVER

(75) Inventor: Che-Li Lin, Taipei (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 1315 days.

(21) Appl. No.: 11/467,924

(22) Filed: Aug. 29, 2006

(65) Prior Publication Data

US 2007/0182690 A1 Aug. 9, 2007

Related U.S. Application Data

(60) Provisional application No. 60/766,701, filed on Feb. 7, 2006.

(51) Int. Cl.
*G09G 3/36* (2006.01)

(52) U.S. Cl.
USPC ..... 345/100

(58) Field of Classification Search
USPC ..... 345/87–110
See application file for complete search history.

(56) References Cited

U.S. PATENT DOCUMENTS 5,465,102 A * 11/1995 Usui et al. ..... 345/89
6,151,007 A * 11/2000 Kasai et al. ..... 345/95
6,559,839 B1 * 5/2003 Ueno et al. ..... 345/213
6,703,866 B1 3/2004 Arimilli
7,279,982 B1 * 10/2007 Zhou et al. ..... 330/301
2003/0058213 A1 * 3/2003 Okada ..... 345/96
2003/0137521 A1 * 7/2003 Zehner et al. ..... 345/589
2004/0080887 A1 4/2004 Feast
2004/0123197 A1 * 6/2004 Sunter et al. ..... 324/761
2005/0219189 A1 10/2005 Fukuo
2006/0013331 A1 * 1/2006 Choi et al. ..... 375/288
2006/0262065 A1 * 11/2006 Luo et al. ..... 345/98

FOREIGN PATENT DOCUMENTS

JP H11265168 A 9/1999
JP 2002152287 A 5/2002
JP 2003140615 A 5/2003
JP 200438030 A 2/2004
TW 200307905 12/2003
WO WO 2007035015 A1 * 3/2007

* cited by examiner

*Primary Examiner* — Allison Walthall
(74) *Attorney, Agent, or Firm* — Winston Hsu; Scott Margo

(57) ABSTRACT

A receiver for an LCD source driver of an LCD panel includes a converter, a comparing circuit and a decoding circuit. The converter converts two pairs of differential current signals into two pairs of differential voltage signals. The comparing circuit is coupled to the converter for generating reference signals based on differences between the two pairs of differential voltage signals. The decoding circuit is coupled to the comparing circuit for generating data signals, clock signal, setting signals, and control signals based the reference signals.

16 Claims, 11 Drawing Sheets

| Case | Current loop | | Comparator logic output | | | Decoded data | | |
|---|---|---|---|---|---|---|---|---|
| | $I_{AD}$ | $I_{BC}$ | $V_{CD}$ | $V_{AC}$ | $V_{AD}$ | Data(1) | Data(0) | CLK |
| 1 | 2I | I | 1 | 1 | 1 | 1 | 1 | 1 |
| 2 | 2I | -I | 1 | 1 | 1 | | | 0 |
| 3 | 2I | 2I | ? | 1 | 1 | | | |
| 4 | 2I | -2I | 1 | ? | 1 | | | |
| 5 | -2I | I | 0 | 0 | 0 | 0 | 0 | 1 |
| 6 | -2I | -I | 0 | 0 | 0 | | | 0 |
| 7 | -2I | 2I | 0 | ? | 0 | | | |
| 8 | -2I | -2I | ? | 0 | 0 | | | |
| 9 | I | I | ? | 1 | 1 | | | |
| 10 | I | -I | 1 | ? | 1 | | | |
| 11 | I | 2I | 0 | 1 | 1 | 1 | 0 | 1 |
| 12 | I | -2I | 1 | 0 | 1 | | | 0 |
| 13 | -I | I | 0 | ? | 0 | | | |
| 14 | -I | -I | ? | 0 | 0 | | | |
| 15 | -I | 2I | 0 | 1 | 0 | 0 | 1 | 1 |
| 16 | -I | -2I | 1 | 0 | 0 | | | 0 |

Fig. 7

| CLK=1 / CLK=0 | | Data[1,0] | | | |
|---|---|---|---|---|---|
| | | 00 | 01 | 10 | 11 |
| Data[1,0] | 00 | 0000 | 0001 | 0010 | 0011 |
| | 01 | 0100 | 0101 | 0110 | 0111 |
| | 10 | 1000 | 1001 | 1010 | 1011 |
| | 11 | 1100 | 1101 | 1110 | 1111 |

Fig. 8

| Case | Current loop | | Comparator logic output | | | | | Decoded data | | |
|---|---|---|---|---|---|---|---|---|---|---|
| | $I_{AD}$ | $I_{BC}$ | $V_{AB}$ | $V_{CD}$ | $V_{AC}$ | $V_{BD}$ | $V_{AD}$ | Data(1) | Data(0) | CLK |
| 1 | 2I | I | 1 | 1 | 1 | 1 | 1 | 1 | 1 | 1 |
| 2 | 2I | -I | 1 | 1 | 1 | 1 | 1 | | | 0 |
| 3 | 2I | 2I | ? | ? | 1 | 1 | 1 | | | |
| 4 | 2I | -2I | 1 | 1 | ? | ? | 1 | | | |
| 5 | -2I | I | 0 | 0 | 0 | 0 | 0 | 0 | 0 | 1 |
| 6 | -2I | -I | 0 | 0 | 0 | 0 | 0 | | | 0 |
| 7 | -2I | 2I | 0 | 0 | ? | ? | 0 | | | |
| 8 | -2I | -2I | ? | ? | 0 | 0 | 0 | | | |
| 9 | I | I | ? | ? | 1 | 1 | 1 | | | |
| 10 | I | -I | 1 | 1 | ? | ? | 1 | | | |
| 11 | I | 2I | 0 | 0 | 1 | 1 | 1 | 1 | 0 | 1 |
| 12 | I | -2I | 1 | 1 | 0 | 0 | 1 | | | 0 |
| 13 | -I | I | 0 | 0 | ? | ? | 0 | | | |
| 14 | -I | -I | ? | ? | 0 | 0 | 0 | | | |
| 15 | -I | 2I | 0 | 0 | 1 | 1 | 0 | 0 | 1 | 1 |
| 16 | -I | -2I | 1 | 1 | 0 | 0 | 0 | | | 0 |

Fig. 11

RECEIVER FOR AN LCD SOURCE DRIVER

CROSS REFERENCE TO RELATED APPLICATIONS

This application claims the benefit of the filing date of U.S. provisional patent application No. 60/766,701, filed on Feb. 7, 2006, the contents of which are hereby incorporated by reference.

BACKGROUND OF THE INVENTION

1. Field of the Invention

The present invention relates to a receiver for an LCD source driver, and more particularly, to a receiver for an LCD source driver capable of reducing skew issue between different signals.

2. Description of the Prior Art

With rapid development of display technologies, traditional cathode ray tube (CRT) displays have been gradually replaced by flat panel displays (FPDs) that have been widely applied in various electronic products such as notebook computers, personal digital assistants (PDAs), flat panel televisions, or mobile phones. Common FPD devices include thin-film transistor liquid crystal display (TFT-LCD) devices, low temperature poly silicon liquid crystal display (LTPS-LCD) devices, and organic light emitting diode (OLED) display devices. The driving system of a display device includes a timing controller, a source driver, a gate driver and signal lines (such as clock lines, data lines and control lines) for transmitting various signals.

Reference is made to FIG. 1 and FIG. 2. FIG. 1 illustrates a prior art L-configuration LCD device 10, and FIG. 2 illustrates a prior art T-configuration LCD device 20. Each of the LCD devices 10 and 20 includes an LCD panel 12, a timing controller 14, a plurality of gate drivers 16, a plurality of source drivers $CD_1$-$CD_n$, and a plurality of signal lines. The timing controller 14 generates data signals $DATA_1$-$DATA_m$ corresponding to images to be displayed by the LCD panel 12, setting signals for setting the pin voltage levels of the source drivers $CD_1$-$CD_n$, together with a clock signal CLK and control signals for driving the LCD panel 12. The setting signals shown in FIGS. 1 and 2 include DATAPOL signal, SHL/SHR signal for respectively setting the data-inversion pin, the shift-left/shift-right pin of the source drivers $CD_1$-$CD_n$. Another way to set the pin voltage levels of the source drivers $CD_1$-$CD_n$ is to use pull-high or pull-low resistors on the driving system. The control signals shown in FIGS. 1 and 2 include latch control signal LD, polarity control signal POL, and start pulse signal SP. The start pulse signal SP is transmitted from the timing controller 14 to the source driver CD1 via a signal line of a transistor-transistor logic (TTL) interface, a complementary-metal-oxide-semiconductor (CMOS) interface or other compatible interfaces, and then from the source driver $CD_1$ to subsequent source drivers sequentially. The clock signal CLK, the setting signals (DATAPOL, SHL/SHR), other control signals (LD and POL) and the data signals $DATA_1$-$DATA_m$ are transmitted from the timing controller 14 to the source drivers $CD_1$-$CD_n$ via corresponding signal lines of a reduced swing differential signaling (RSDS) interface. Among them, the setting signals (such as DATAPOL, SHL/SHR) can be also hard-wired set in the pins of the source drivers $CD_1$-$CD_n$. The control signals (such as LD and POL) can also be transmitted via a TTL interface, a CMOS interface or other compatible interfaces.

Reference is made to FIG. 3 for a functional diagram illustrating a source driver of the prior art LCD devices 10 and 20. The source driver of the prior art LCD devices 10 and 20 each includes a processing unit 32 and an RSDS receiver 34. The RSDS receiver 34 receives the data signals $DATA_1$-$DATA_m$ and the clock signal CLK generated by the timing controller 14 and transmits the received signals to the processing unit 32. The processing unit 32, including an output buffer, a digital-to-analog converter (DAC) and a data latch, also receives control signals and setting signals generated by the timing controller 14, together with bias voltages for operating the output buffer, the DAC and the data latch. The control signals include polarity control signal POL, start pulse signal SP and latch control signals LD. The setting signals include DATAPOL, SHL, SHR, CSR, CS and LPC for respectively setting the data-inversion pin, the shift-left pin, the shift-right pin, the charge sharing/recycling enable pin, the channel select pin and the low power control pin of the source driver. The supply voltages include input voltages VCC, GND, VDDA, GNDA. The gamma reference voltages include VGMA.

In the prior art LCD devices 10 and 20, the data, clock, control and setting signals are transmitted via respective signals lines of an RSDS interface, a TTL interface or a CMOS interface. The RSDS/TTL/CMOS interface provides a bus type transmission that easily results in signal skewing, making it difficult to adjust timing parameters, such as the setup time or the hold time. Therefore, the data rate or the clock rate cannot be increased for high-speed operations in high-resolution display devices. Also, the clock and data signals are transmitted via different signal lines. With increasing demand for large-sized applications, the printed circuit board (PCB), on which the signal lines are disposed, also increases with panel size. Therefore, the trace delay from the timing controller to different source drivers also varies, thus making it even more difficult to adjust skew issue and the timing parameters. In the prior art LCD devices 10 and 20, various signals are transmitted via respective signals lines which occupy large circuit space on the PCB. The synchronization between the control signals and the clock signal in high-speed operations cannot be addressed by the prior art LCD devices 10 and 20. Also, setting signals are required for setting various pins of the source drivers (such as shift-right/shift-left pin, data-inversion pin, low-power-mode pin, and charge-sharing-mode pin) so that each source driver can function properly. Thus, the total number of input pins of the source drivers will be increased. Subsequently, the pin pitch of the source drivers has to be reduced and the yield of the bonding process will be lowered. The manufacturing costs of the display devices will be increased.

SUMMARY OF THE INVENTION

The present invention provides a receiver for a source driver of an LCD panel comprising a converter for converting two pairs of differential signals from a first format into a second format; a comparing circuit coupled to the converter for generating reference signals based on differences between the two pairs of differential signals of the second format; and a decoding circuit coupled to the comparing circuit for generating data signals, clock signals, setting signals and control signals based on the reference signals.

The present invention also provides a source driver for driving an LCD panel comprising a receiver and a processing device. The receiver for receiving a plurality of differential signals comprises a comparator for comparing the plurality of differential signals and outputting a plurality of compared signals; and a decoder for generating a plurality of image data signals and a plurality of control signals in accordance with the plurality of compared signals. The processing device for generating the driving signals to the LCD panel in accordance with the image data signals and the control signals comprises a data latch for latching the plurality of image data signals; a digital-to-analog-converter for converting the image data signals into a plurality of analog signals; and an output buffer for enhancing the driving ability of the analog signals.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 7 is a truth table corresponding to the comparing/decoding circuit according to the first and second embodiments of the present invention.

FIG. 8 is a table showing an example of data mapping obtained from the truth table of FIG. 7.

FIG. 11 is a truth table corresponding to the comparing/decoding circuit according to the third and fourth embodiments of the present invention.

DETAILED DESCRIPTION

Figure 1:
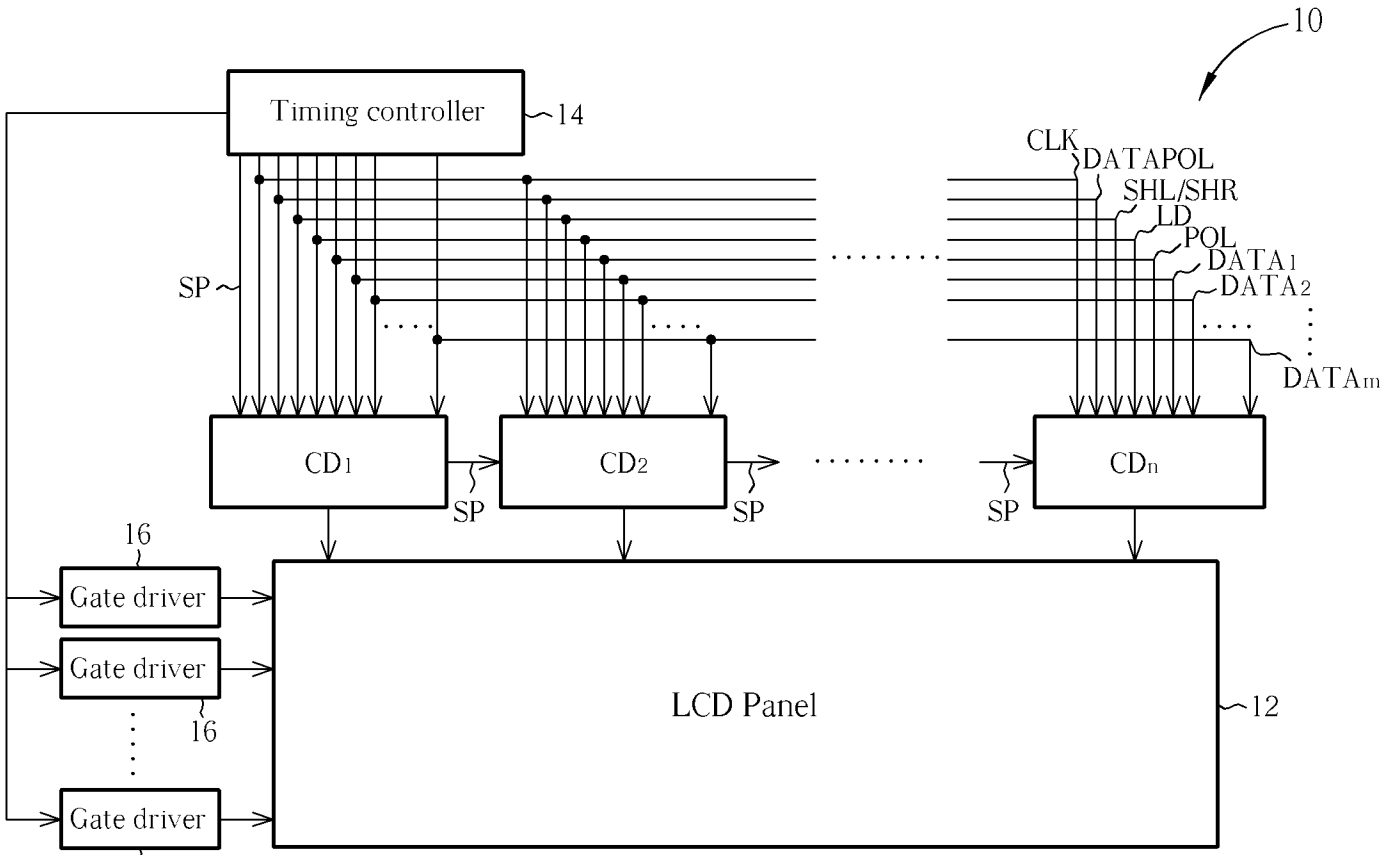
Fig. 1 Prior Art
FIG. 1 is a diagram of a prior art L-configuration LCD device.
Figure 2:
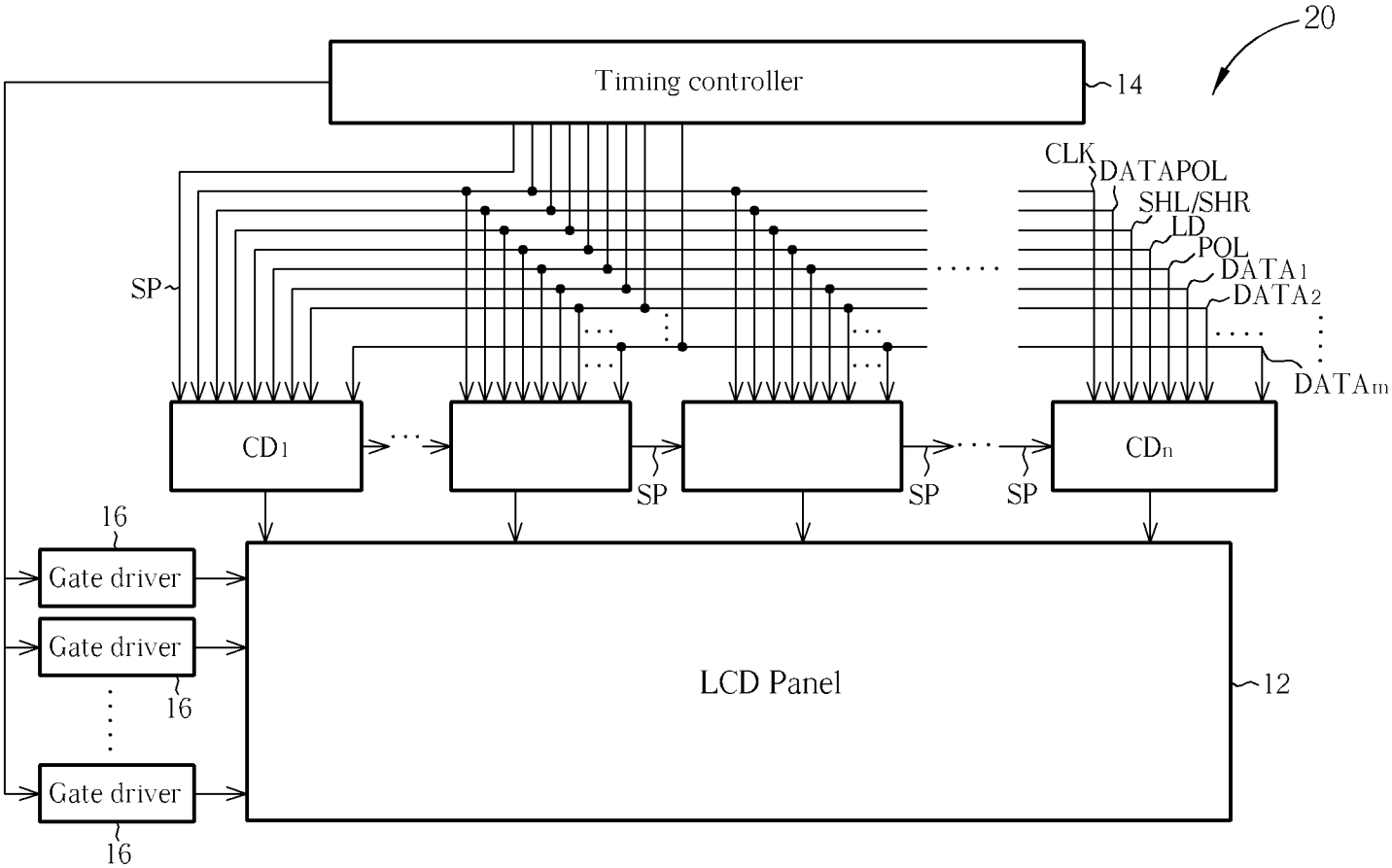
Fig. 2 Prior Art
FIG. 2 is a diagram of a prior art T-configuration LCD device.
Figure 3:
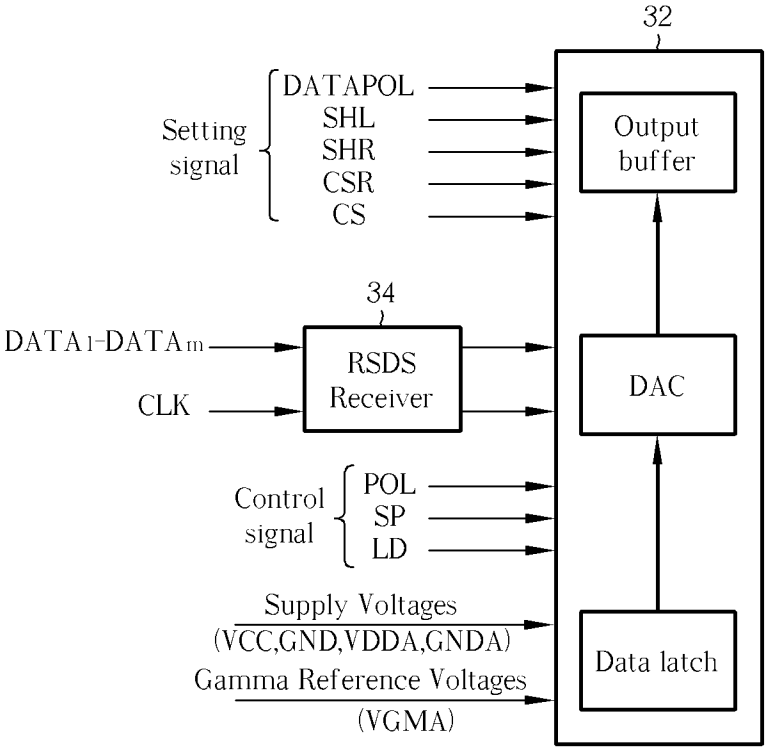
Fig. 3 Prior Art
FIG. 3 is a functional diagram of a source driver of the prior art LCD devices in FIGS. 1 and 2.
Figure 4:
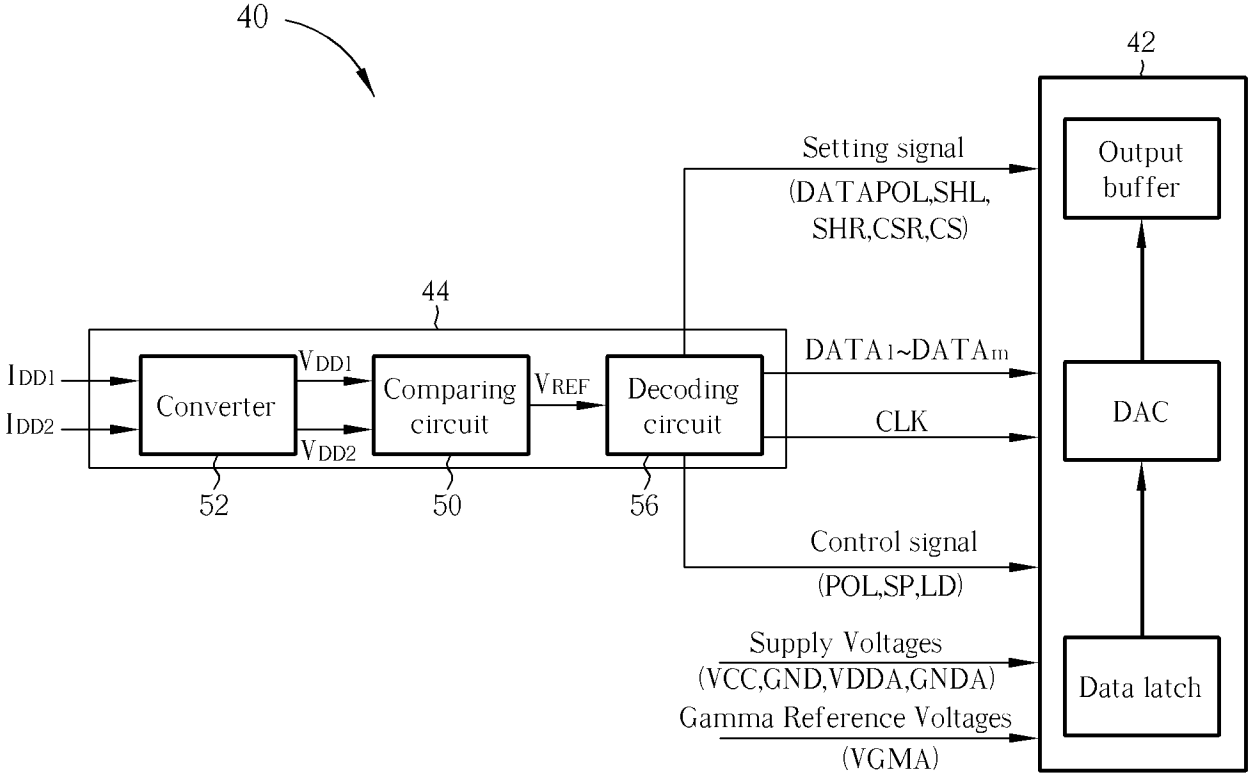
FIG. 4 is a functional diagram of a source driver in an LCD device according to the present invention.

Reference is made to FIG. 4 for a functional diagram illustrating a source driver 40 of an LCD device according to the present invention. The source driver 40 includes a processing unit 42 and a receiver 44. The receiver 44, including a converter 52, a comparing circuit 50 and a decoding circuit 56, receives two pairs of differential signals $I_{DD1}$ and $I_{DD2}$ that are embedded with data signals, control signals, clock signal and setting signals sent from a timing controller. The converter 52 of the receiver 44 can include a current-to-voltage converter capable of converting the two pairs of differential current signals $I_{DD1}$ and $I_{DD2}$ into two pairs of differential voltage signals $V_{DD1}$ and $V_{DD2}$. Based on the received differential voltage signals $V_{DD1}$ and $V_{DD2}$, the comparing circuit 50 of the receiver 44 generates corresponding reference signals $V_{REF}$. Based on the received reference signals $V_{REF}$, the decoding circuit 56 of the receiver 44 can thereby generate corresponding data signals, control signals, clock signal and setting signals for the processing unit 42.

The processing unit 42, including an output buffer, a DAC and a data latch, receives the data signals, control signals, clock signal and setting signals generated by the receiver 44, together with supply voltages and gamma reference voltages for operating the output buffer, the DAC and the data latch. The control signals can include polarity control signal POL, start pulse signal SP and latch control signals LD. The setting signals can include DATAPOL, SHL/SHR, CSR, CS and LPC for respectively setting the data-inversion pin, the shift-left/shift-right pin, the charge sharing/recycling enable pin, the channel select pin and the low power control pin of the source driver 40. The supply voltages can include input voltages VCC, GND, VDDA, GNDA. The gamma reference voltages include VGMA. The definitions and functions of the data signals, control signals, clock signals and setting signals are well known to those skilled in the art and will not be described in more detail.

Figure 5:
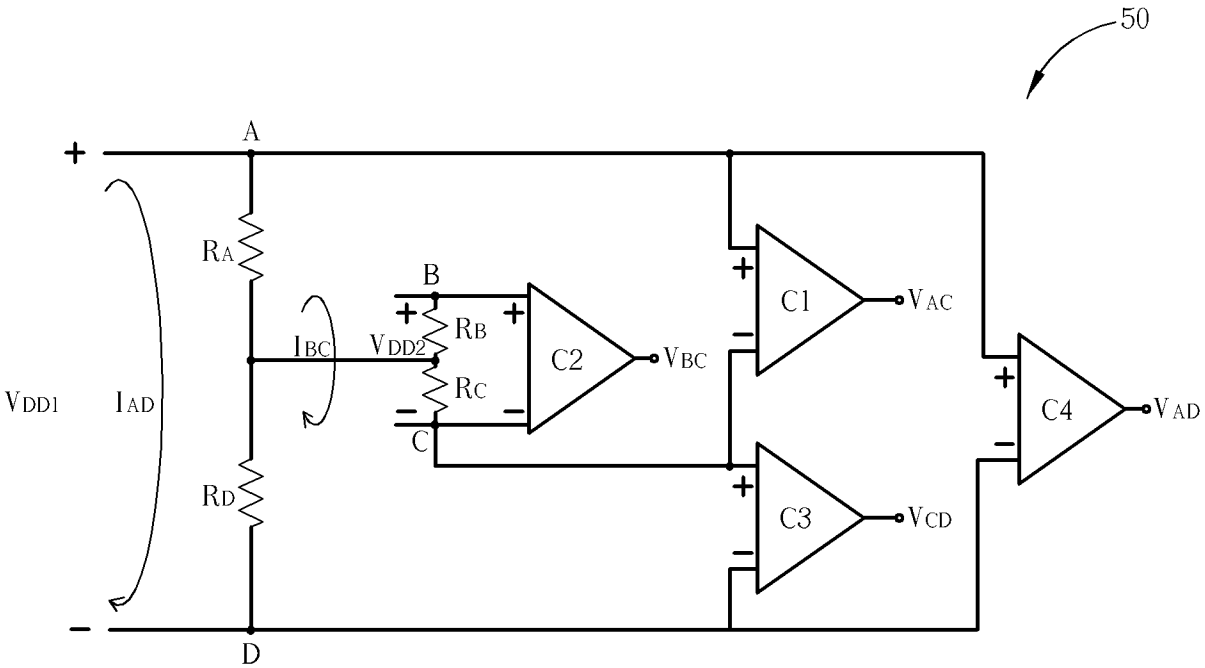
FIG. 5 is a circuit diagram of a comparing circuit according to a first embodiment of the present invention.
Figure 6:
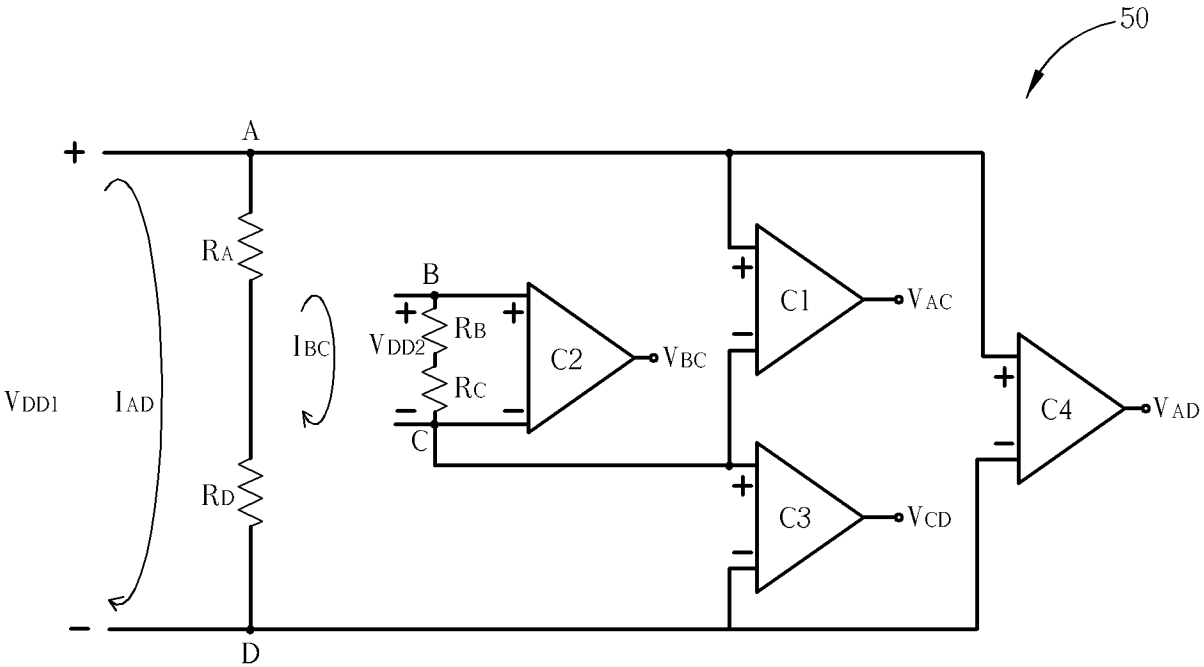
FIG. 6 is a circuit diagram of a comparing circuit according to a second embodiment of the present invention.

References are made to FIGS. 5 and 6 for circuit diagrams of the comparing circuit 50 according to a first and a second embodiment of the present invention. The comparing circuit 50 in FIGS. 5 and 6 includes comparators C1-C4 and resistors $R_A$-$R_D$. Nodes A-D of the comparing circuit 50 are coupled to the converter 52, so that the differential voltage signal $V_{DD1}$ is applied across node A and node D and the differential voltage signal $V_{DD2}$ is applied across node B and C. Nodes A and C represent the input nodes of the comparator C1, nodes B and C represent the input nodes of the comparator C2, nodes C and D represent the input nodes of the comparator C3, and nodes A and D represent the input nodes of the comparator C4. The resistors $R_A$ and $R_D$ are coupled in series between node A and node D, and the resistors $R_B$ and $R_C$ are coupled in series between node B and node C. With the resistors $R_A$-$R_D$, the differential voltage signal $V_{DD1}$ and $V_{DD2}$ can be generated based on two current loops $I_{AD}$ and $I_{BC}$ (indicated by the arrows in FIGS. 5 and 6), and voltages established at the input nodes of the comparators C1-C4 are therefore depending on the differential voltage signals $V_{DD1}$ and $V_{DD2}$. The comparators C1-C4 generate corresponding output reference voltages $V_{AC}$, $V_{BC}$, $V_{CD}$, and $V_{AD}$ based on the voltages established at respective input nodes. Therefore, the decoding circuit 56 of the present invention can generate corresponding data signals, control signal, clock signals and setting signals based on the reference voltages $V_{AC}$, $V_{BC}$, $V_{CD}$, and $V_{AD}$. In the first embodiment of the present invention, a node between the resistors $R_A$ and $R_D$ is coupled to a node between the resistors $R_B$ and $R_C$, as illustrated in FIG. 5. In the second embodiment of the present invention, a node between the resistors $R_A$ and $R_D$ is not coupled to a node between the resistors $R_B$ and $R_C$, as illustrated in FIG. 6.

Reference is made to FIG. 7 for a truth table corresponding to the comparing circuit 50 according to the first and second embodiments of the present invention. In FIG. 7, the unit of the current loops $I_{AD}$ and $I_{BC}$ is represented by I, "+" indicates a current flow along the direction of the arrows, and "−" indicates a current flow opposite to the direction of the arrows. The output reference voltages $V_{AC}$, $V_{CD}$, and $V_{AD}$ of the comparators C1-C4 are represented using logic levels, wherein "1" means a logic-high output, "0" means a logic-low output and "?" represents an unknown state in which the comparators C1-C4 are unable to generate logic outputs based on the input voltages. The decoded data of the decoding circuit 56 are also represented using logic levels, where "1" means a logic-high output and "0" means a logic-low output.

Reference is made to FIG. 8 for a table showing an example of data mapping obtained from the truth table of FIG. 7. Based on the logic levels of the decoded data Data[1,0] and CLK, 16 different data mappings can be obtained in a clock period (CLK=1 and CLK=0). Therefore, the decoding circuit 56 of the present invention can generate corresponding data signals, control signals, clock signal and setting signals based on different data mappings.

Figure 9:
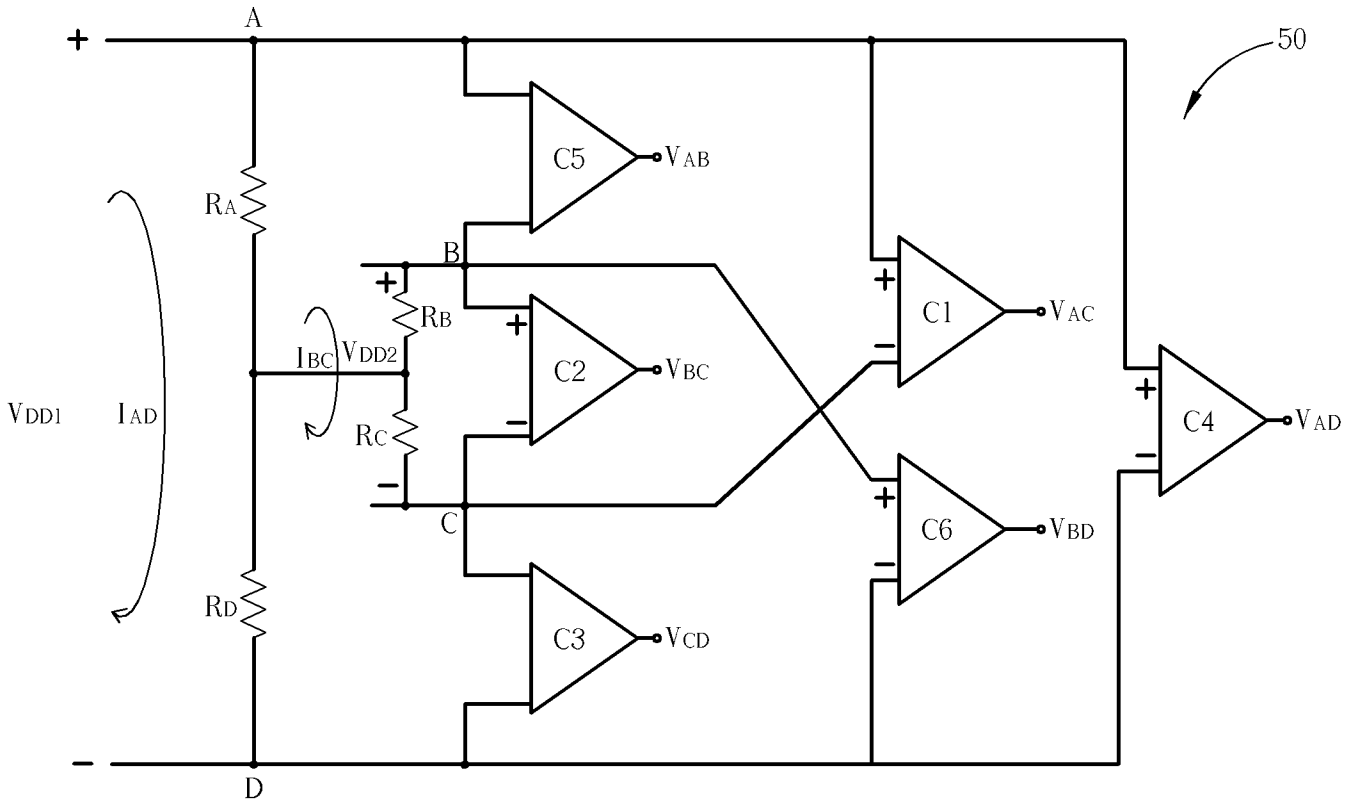
FIG. 9 is a circuit diagram of a comparing circuit according to a third embodiment of the present invention.
Figure 10:
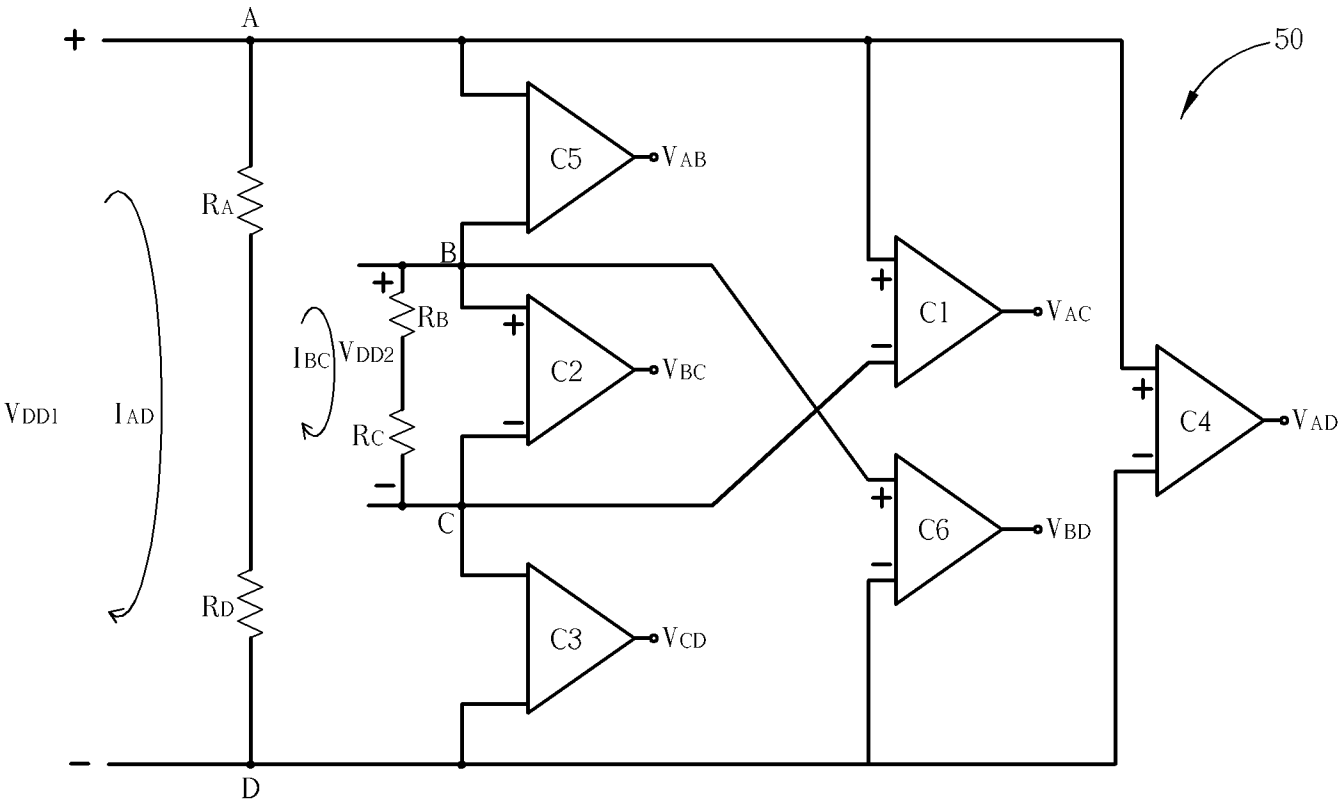
FIG. 10 is a circuit diagram of a comparing circuit according to a fourth embodiment of the present invention.

References are made to FIGS. 9 and 10 for circuit diagrams of the comparing circuit 50 according to a third and a fourth embodiment of the present invention. The comparing circuit 50 in FIGS. 9 and 10 includes comparators C1-C6 and resistors $R_A$-$R_D$. Nodes A-D of the comparing circuit 50 are coupled to the converter 52, so that the differential voltage signal $V_{DD1}$ is applied across node A and node D and the differential voltage signal $V_{DD2}$ is applied across node B and C. Nodes A and C represent the input nodes of the comparator C1, nodes B and C represent the input nodes of the comparator C2, nodes C and D represent the input nodes of the comparator C3, nodes A and D represent the input nodes of the comparator C4, nodes A and B represent the input nodes of the comparator C5, and nodes B and D represent the input nodes of the comparator C6. The resistors $R_A$ and $R_D$ are coupled in series between node A and node D, and the resistors $R_B$ and $R_C$ are coupled in series between node B and node C. With the resistors $R_A$-$R_D$, the differential voltage signal $V_{DD1}$ and $V_{DD2}$ can be generated based on two current loops $I_{AD}$ and $I_{BC}$ (indicated by the arrows in FIGS. 9 and 10), and voltages established at the input nodes of the comparators C1-C6 are therefore depending on the differential voltage signal $V_{DD1}$ and $V_{DD2}$. The comparators C1-C6 generate corresponding output reference voltages $V_{AC}$, $V_{BC}$, $V_{CD}$, $V_{AD}$, $V_{AB}$, and $V_{BD}$ based on the voltages established at respective input nodes. Therefore, the decoding circuit 56 of the present invention can generate corresponding data signals, control signals, clock signal and setting signals based on the reference voltages $V_{AC}$, $V_{BC}$, $V_{CD}$, $V_{AD}$, $V_{AB}$, and $V_{BD}$. In the third embodiment of the present invention, a node between the resistors $R_A$ and $R_D$ is coupled to a node between the resistors $R_B$ and $R_C$, as illustrated in FIG. 9. In the fourth embodiment of the present invention, a node between the resistors $R_A$ and $R_D$ is not coupled to a node between the resistors $R_B$ and $R_C$, as illustrated in FIG. 10.

Reference is made to FIG. 11 for a truth table corresponding to the comparing circuit 50 according to the third and fourth embodiments of the present invention. In FIG. 11, the unit of the current loops $I_{AD}$ and $I_{BC}$ is represented by I, "+" indicates a current flow along the direction of the arrows, and "−" indicates a current flow opposite to the direction of the arrows. The output reference voltages $V_{AB}$, $V_{CD}$, $V_{AC}$, $V_{BD}$, $V_{BC}$, and $V_{AD}$ of the comparators C1-C6 are represented using logic levels, wherein "1" means a logic-high output, "0" means a logic-low output and "?" represents an unknown state in which the comparators C1-C6 are unable to generate logic outputs based on the input voltages. The decoded data of the decoding circuit 56 are also represented using logic levels, where "1" means a logic-high output and "0" means a logic-low output.

The table shown in FIG. 8 can also be used for illustrating an example of data mapping obtained from the truth table of FIG. 11. Based on the logic levels of the decoded data Data [1,0] and CLK, 16 different data mappings can be obtained in a clock period (CLK=1 and CLK=0). Therefore, the decoding circuit 56 of the present invention can generate corresponding data signals, control signals, clock signals and setting signals based on different data mappings.

In the present invention, the clock signal, the setting signals and the control signals are embedded into the data signals, and the embedded signals are transmitted as two pairs of differential current signals $I_{DD1}$ and $I_{DD2}$. The converter of the present invention converts the two pairs of differential current signals $I_{DD1}$ and $I_{DD2}$ into two pairs of differential voltage signals $V_{DD1}$ and $V_{DD2}$. Based on the received differential voltage signals $V_{DD1}$ and $V_{DD2}$, the comparing circuit of the present invention then generates corresponding reference signals $V_{REF}$ (such as the output reference voltages $V_{AC}$, $V_{BC}$, $V_{CD}$, $V_{AD}$, $V_{BD}$, and $V_{AB}$). Based on the received reference signals $V_{REF}$, the decoding circuit of the present invention can thereby generate corresponding data signals, control signals, clock signal and setting signals for the LCD device.

Therefore, the present invention can reduce signal reflection and skew issue in high-speed operations, making it easier to adjust timing parameters, such as the setup time and the hold time. In addition, since the setting signals are also embedded into the data signals, the pin pitch of the source drivers can be increased and the yield of the bonding process will be higher. Therefore, the present can reduce manufacturing costs and improve the efficiency of data transmission in the display devices.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A receiver for a source driver of an LCD panel comprising:

a converter for converting two pairs of differential current signals that are embedded with data signals and control signals sent from a timing controller from being two pairs of differential current signals into two pairs of differential voltage signals;

a comparing circuit coupled to the converter for generating reference voltage signals based on differences between the two pairs of differential voltage signals, the comparing circuit comprising:

a first and a fourth node for receiving a first pair of the two pairs of differential voltage signals;

a second and a third node for receiving a second pair of the two pairs of differential voltage signals;

a plurality of resistors for generating a plurality of input signals based on the two pairs of differential voltage signals;

a plurality of comparators coupled to corresponding resistors for receiving corresponding input signals and thereby generating the reference voltage signals;

a plurality of first resistors coupled in series between the first and fourth nodes of the comparing circuit; and a plurality of second resistors coupled in series between the second and third nodes of the comparing circuit;

wherein a node between two first resistors is coupled to a node between two second resistors; and a decoding circuit coupled to the comparing circuit for generating the embedded data signals and control signals based on the reference voltage signals.

2. The receiver of claim 1 wherein the control signals comprise a clock signal and setting signals.

3. The receiver of claim 1 wherein the comparing circuit generates the reference voltage signals of logic high or logic low levels based on values of corresponding input signals.

4. The receiver of claim 1 wherein the comparing circuit generates a lookup table containing the reference voltage signals of logic high or logic low levels based on values of corresponding input signals.

5. The receiver of claim 4 wherein the decoding circuit generates the data signals, the clock signals and the control signals based on the lookup table.

6. The receiver of claim 4 wherein the decoding circuit further generates settings for the source driver based on the lookup table.

7. The receiver of claim 1 wherein the comparing circuit comprises:

a first comparator including:

a first input end coupled to the first node of the comparing circuit;

a second input end coupled to the third node of the comparing circuit; and an output end coupled to the decoding circuit;

a second comparator including:

a first input end coupled to the second node of the comparing circuit;

a second input end coupled to the third node of the comparing circuit; and an output end coupled to the decoding circuit;

a third comparator including:

a first input end coupled to the third node of the comparing circuit;

a second input end coupled to the fourth node of the comparing circuit; and an output end coupled to the decoding circuit; and a fourth comparator including:

a first input end coupled to the first node of the comparing circuit;

a second input end coupled to the fourth node of the comparing circuit; and an output end coupled to the decoding circuit.

8. A source driver for driving an LCD panel comprising:

a timing controller for transmitting a plurality of differential signals comprising a plurality of image data signals and a plurality of control signals;

a receiver for receiving the plurality of differential signals, comprising:

a comparing circuit coupled to the receiver for generating reference voltage signals based on differences between the plurality of differential voltage signals, the comparing circuit comprising:

a first and a fourth node for receiving a first pair of two pairs of differential voltage signals of the plurality of differential signals;

a second and a third node for receiving a second pair of the two pairs of differential voltage signals of the plurality of differential signals;

a plurality of resistors for generating a plurality of input signals based on the two pairs of differential voltage signals;

a plurality of comparators coupled to corresponding resistors for receiving corresponding input signals and thereby generating the reference voltage signals;

a plurality of first resistors coupled in series between the first and fourth nodes of the comparing circuit; and a plurality of second resistors coupled in series between the second and third nodes of the comparing circuit;

wherein a node between two first resistors is coupled to a node between two second resistors; and a decoder for generating the plurality of image data signals and the plurality of control signals in accordance with the plurality of compared signals; and a processing device for generating the driving signals to the LCD panel in accordance with the image data signals and the control signals, comprising:

a data latch for latching the plurality of image data signals;

a digital-to-analog-converter for converting the image data signals into a plurality of analog signals; and an output buffer for enhancing the driving ability of the analog signals.

9. The source driver of claim 8 wherein the decoder generates the plurality of control signals comprising a clock signal and setting signals.

10. The source driver of claim 8 wherein the receiver further comprises a converter for converting formats of the plurality of differential signals.

11. The source driver of claim 8 wherein the receiver further comprises a resistor coupled to the comparing circuit for comparing the plurality of differential signals.

12. The source driver of claim 8 wherein the comparing circuit outputs the plurality of compared signals of logic high or logic low levels based on values of the plurality of differential signals.

13. The source driver of claim 12 wherein the comparing circuit further generates a lookup table containing the plurality of compared signals of logic high or logic low levels.

14. The source driver of claim 13 wherein the decoder generates the plurality of image data signals and the plurality of control signals in accordance with the lookup table.

15. A receiver for a source driver of an LCD panel comprising:

a converter for converting two pairs of differential current signals that are embedded with data signals and control signals sent from a timing controller from being two pairs of differential current signals into two pairs of differential voltage signals;

a comparing circuit coupled to the converter for generating reference voltage signals based on differences between the two pairs of differential voltage signals, the comparing circuit comprising:

a first and a fourth node for receiving a first pair of the two pairs of differential voltage signals;

a second and a third node for receiving a second pair of the two pairs of differential voltage signals;

an output node;

a first comparator including:

a first input end coupled to the first node of the comparing circuit;

a second input end coupled to the third node of the comparing circuit; and an output end coupled to the output node of the comparing circuit;

a second comparator including:

a first input end coupled to the second node of the comparing circuit;

a second input end coupled to the third node of the comparing circuit; and an output end coupled to the output node of the comparing circuit;

a third comparator including:

a first input end coupled to the third node of the comparing circuit;

a second input end coupled to the fourth node of the comparing circuit; and an output end coupled to the output node of the comparing circuit;

a fourth comparator including:

a first input end coupled to the first node of the comparing circuit;

a second input end coupled to the fourth node of the comparing circuit; and an output end coupled to the output node of the comparing circuit;

a fifth comparator including:

a first input end coupled to the first node of the comparing circuit;

a second input end coupled to the second node of the comparing circuit; and an output end coupled to the output node of the comparing circuit; and a sixth comparator including:

a first input end coupled to the second node of the comparing circuit;

a second input end coupled to the fourth node of the comparing circuit; and an output end coupled to the output node of the comparing circuit; and a decoding circuit coupled to the output node of the comparing circuit for generating the embedded data signals and control signals based on the reference voltage signals.

16. The receiver of claim 15 further comprising:

a plurality of first resistors coupled in series between the first and fourth nodes of the comparing circuit; and a plurality of second resistors coupled in series between the second and third nodes of the comparing circuit;

wherein a node between two first resistors is coupled to a node between two second resistors.

* * * * *